US007182586B2

(12) United States Patent
Kim et al.

(10) Patent No.: US 7,182,586 B2
(45) Date of Patent: Feb. 27, 2007

(54) SCROLL COMPRESSOR

(75) Inventors: Myung-Kyun Kim, Incheon (KR); Byeong-Chul Lee, Seoul (KR); Dong-Won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 154 days.

(21) Appl. No.: 11/034,774

(22) Filed: Jan. 14, 2005

(65) Prior Publication Data

US 2006/0078451 A1 Apr. 13, 2006

(30) Foreign Application Priority Data

Oct. 7, 2004 (KR) ..... 10-2004-0080021

(51) Int. Cl.
*F03C 2/00* (2006.01)
*F04C 18/00* (2006.01)

(52) U.S. Cl. ..... 418/3; 418/55.1; 418/58; 417/201

(58) Field of Classification Search ..... 418/3, 418/5, 55.1–55.6, 58, 61.1, 209; 417/201, 417/205

See application file for complete search history.

(56) References Cited

U.S. PATENT DOCUMENTS 6,638,040 B2 * 10/2003 Wang et al. ..... 418/3

FOREIGN PATENT DOCUMENTS

| | | | |
|---|---|---|---|
| JP | 03117692 A | * | 5/1991 |
| JP | 05087074 A | * | 4/1993 |
| JP | 07208354 A | * | 8/1995 |
| KR | 20-0143515 Y1 | | 6/1999 |
| KR | 2003-0040899 A | | 5/2003 |
| KR | 10-2006-0002820 A | | 1/2006 |

* cited by examiner

*Primary Examiner*—Theresa Trieu
(74) *Attorney, Agent, or Firm*—Birch, Stewart, Kolasch & Birch, LLP

(57) ABSTRACT

A scroll compressor includes: a frame fixedly installed in the casing to support a rotary shaft of the driving motor and having a second suction opening at its one side and a second discharge opening at its other side; a fixed scroll fixedly installed at the frame and having a first suction opening at its edgemost and a first discharge opening at its central portion; an orbiting scroll forming a first compression chamber by being engaged with the fixed scroll; a self-rotation preventing member interposed between the frame and the orbiting scroll for preventing a self-rotation of the orbiting scroll; and a vane making a linear movement in a radial direction of the frame according to an orbiting movement of the orbiting scroll, and forming between the frame and the orbiting scroll a second compression chamber including a spaces where the second suction and discharge opening exists.

17 Claims, 12 Drawing Sheets

SCROLL COMPRESSOR

BACKGROUND OF THE INVENTION

1. Field of the Invention

The present invention relates to a scroll compressor, and particularly, to a scroll compressor capable of increasing a discharge capacity and freely varying a capacity.

2. Description of the Conventional Art

In general, a compressor is for converting mechanical energy to compression energy of a compressible fluid, and is commonly divided into a reciprocating type, a scroll type, a centrifugal type and a vane type.

Unlike the reciprocating type, the scroll compressor employs a method in which a gas is sucked, compressed and discharged using a rotating body, like the centrifugal or vane compressor.

Such a scroll compressor is commonly applied to an air conditioner. To improve cooling and heating efficiency of the air conditioner, a scroll compressor which can vary its capacity has been recently required.

FIG. 1 is a longitudinal sectional view showing a conventional scroll compressor.

As shown, the conventional scroll compressor includes: a casing 1 provided with a gas suction pipe (SP) and a gas discharge pipe (DP); a main frame 2 and a sub frame (not shown) fixedly installed at upper and lower sides in the casing 1, respectively; a driving motor 3 mounted between the main frame 2 and the sub frame, for generating a rotary force; a rotary shaft 4 fixed at the center of the driving motor 3 and penetrating the center of the main frame 2 for transferring a rotary force of the driving motor 3; a fixed scroll 5 fixedly installed at an upper surface of the main frame 2; an orbiting scroll 6 put on the upper surface of the main frame 2 so as to orbit and engaged with the fixed scroll 5 to form a plurality of compression chambers (P); a self-rotation preventing member 7 (which is called Oldham's ring) installed between the orbiting scroll 6 and the main frame 2, for preventing self-rotation of the orbiting scroll 6 but allowing its orbiting movement; and a discharge cover 8 coupled to an upper surface of the fixed scroll 5 and dividing the inside of the casing 1 into a low pressure portion (S1) and a high pressure portion (S2).

In general, the fixed scroll 8 fixed at an upper portion of the main frame 2 and the orbiting scroll 6 installed between the fixed scroll 8 and the main frame 2 and orbiting are called a compression unit.

A boss receiving pocket 2*b* for an orbiting movement of a boss portion 6*b* of the orbiting scroll 6 is formed at a central portion of the main frame 2, and a shaft hole 2*a* for supporting the rotary shaft 4 is formed at the center of the boss receiving pocket 2*b*. Key groove portions 2*c* are formed at both sides of an upper surface of the main frame 2, so that lower key portions 7*b* of the self-rotation preventing member 7 slide therein in a radial direction.

A wrap 5*a* forming a compression chamber (P) by being engaged with a wrap 6*a* of the orbiting scroll 6 to be explained later is formed as an involute shape at a lower surface of the fixed scroll 5. A suction opening 5*b* is formed at the edgemost of the wrap 5*a*. And a discharge opening 5*c* communicating with a high pressure portion (S2) of the casing 1 is formed around the center of the fixed scroll 5.

A wrap 6*a* is formed as an involute shape at an upper surface of the orbiting scroll 6 and is engaged with the wrap 5*a* of the fixed scroll 5. And a boss portion 6*b* coupled to an eccentric portion 4*a* of the rotary shaft 4 and making an orbiting movement in the boss receiving pocket 2*b* of the main frame 2 is formed at a central portion of a lower surface of the orbiting scroll 6.

Key groove portions 6*c* are formed at both sides of the boss portion 6*b*, so that upper key portions 7*c* of the self-rotation preventing member 7 slides therein in a radial direction.

As shown in FIG. 2, the self-rotation preventing member 7 includes: a body portion 7*a* formed as a ring shape; lower key portions 7*b* formed at both sides of a lower surface of the body portion 7*a* and slidingly inserted in the key groove portions 2*c* of the main frame 2; and upper key portions 7*c* formed at both sides of an upper surface of the body portion 7*a* and slidingly inserted in the key groove portions 6*c* of the orbiting scroll 6.

An outer circumferential surface of the body portion 7*a* is formed as a perfect circle, and sliding surfaces 7*d* are formed at both sides of its inner circumferential surface. The lower key portions 7*b* and the upper key portions 7*c* are alternately formed every angle of 90 along a radial direction.

The operation of the conventional scroll compressor having such a structure will now be described.

When the rotary shaft 4 of the driving motor 3 is rotated by applied power, the orbiting scroll 6 does not self-rotate but makes an orbiting movement by the self-rotation preventing member 7.

At this time, a compression chamber (P) is formed between the wrap portion 6*a* of the orbiting scroll 6 and the wrap portion 5*a* of the fixed scroll 5. Then, in the compression chamber (P), a refrigerant gas introduced from the suction opening 5*b* toward the discharge opening 5*c* moves toward the discharge opening 5*c* to be discharged by a constant orbiting movement of the orbiting scroll 6.

Namely, the refrigerant gas is sucked into the low pressure portion (S1) of the casing 1 through the gas suction pipe (SP), and is introduced to the edgemost of the compression chamber (P) through the suction opening 5*b* of the fixed scroll 5. Then, by a constant orbiting movement of the orbiting scroll 6, the refrigerant gas is compressed, gradually moving inside the compression chamber (P), and is discharged to the high pressure portion (S2) of the casing 1 through the discharge opening 5*c* of the fixed scroll 5.

However, in the conventional scroll compressor having such a structure, because the refrigerant gas is compressed/discharged only in/from the compression chamber (P) formed by the orbiting scroll 6 and the fixed scroll 5, there is a limit in increasing a capacity of the compressor.

Also, the conventional scroll compressor controls the number of rotation of the driving motor 3 in order to vary a capacity, and should be provided with an expensive controller (not shown) in order to control the capacity, thereby causing an increase in manufacturing cost of the compressor.

In addition, in the conventional scroll compressor, abrasion is badly made between components in a high capacity mode requiring high output, thereby shorting a life span of the compressor, and lubricant oil is not smoothly circulated in the compressor in a low capacity mode requiring low output, thereby degrading compression performance.

SUMMARY OF THE INVENTION

Therefore, an object of the present invention is to provide a scroll compressor capable of increasing a capacity while maintaining a size of a compressor.

Another object of the present invention is to provide a scroll compressor capable of effectively varying a capacity.

To achieve these and other advantages and in accordance with the purpose of the present invention, as embodied and broadly described herein, there is provided a scroll compressor comprising: a driving motor fixedly installed in a casing; a frame fixedly installed in the casing to support a rotary shaft of the driving motor, and having a second suction opening at its one side and a second discharge opening at its other side; a fixed scroll fixedly installed at the frame and having a first suction opening at its edgemost and a first discharge opening at its central portion; an orbiting scroll put on the frame, forming a first compression chamber by being engaged with the fixed scroll, and making an orbiting movement by being coupled to the rotary shaft; a self-rotation preventing member interposed between the frame and the orbiting scroll, for preventing a self-rotation of the orbiting scroll and inducing an orbiting movement of the orbiting scroll; and a vane making a linear movement in a radial direction of the frame according to an orbiting movement of the orbiting scroll, and forming between the frame and the orbiting scroll a second compression chamber including a space where the second suction opening exists and a space where the second discharge opening exists.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
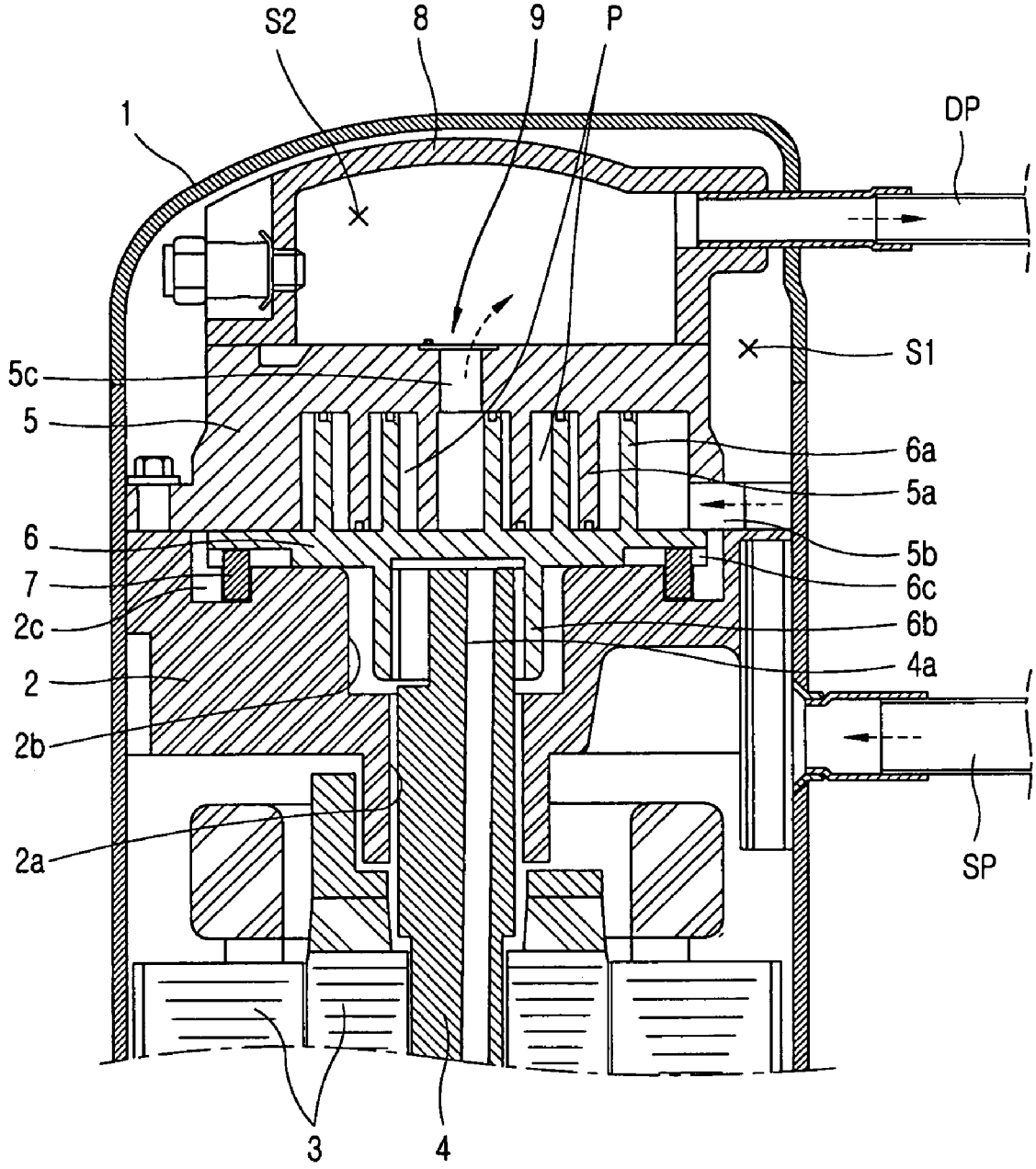
FIG. 1 CONVENTIONAL ART
FIG. 1 is a longitudinal sectional view showing a part of the conventional scroll compressor.
Figure 2:
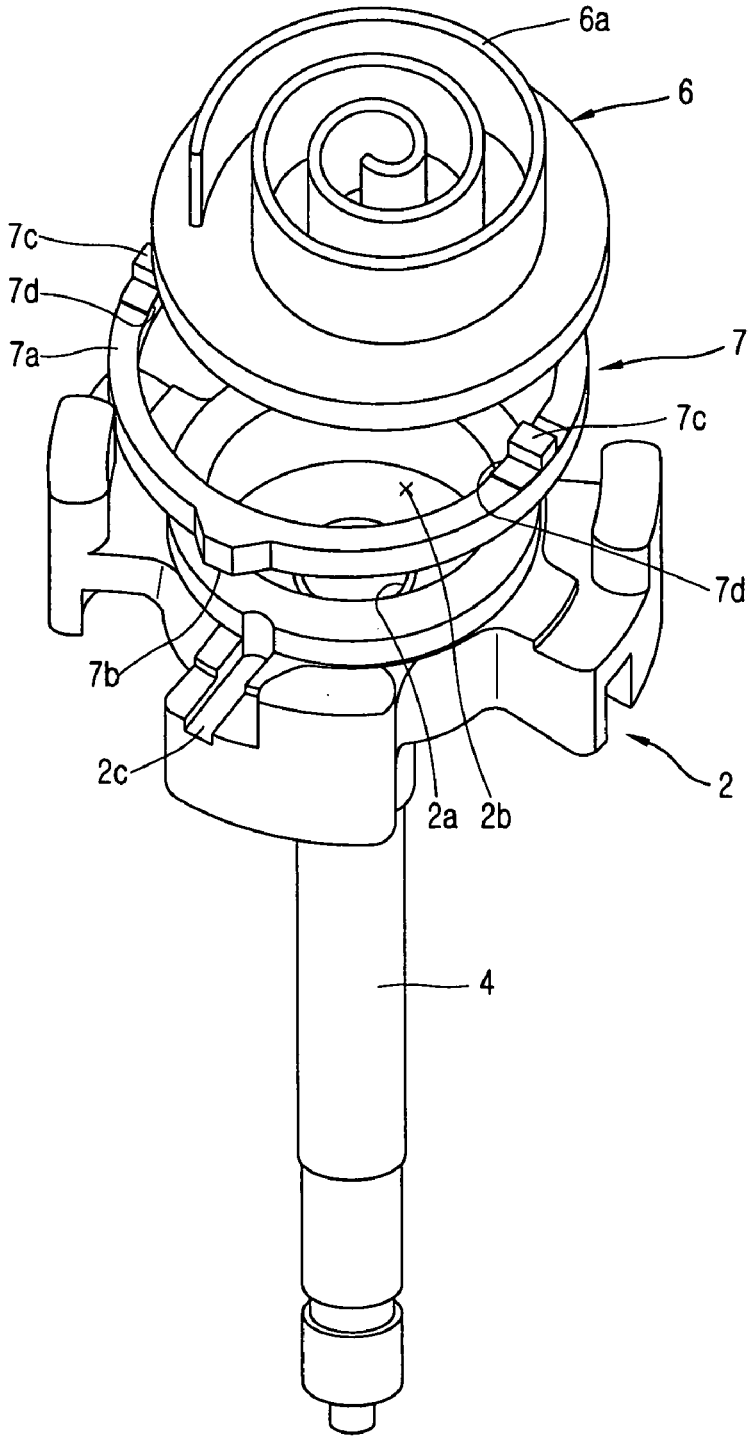
FIG. 2 CONVENTIONAL ART
FIG. 2 is an exploded perspective view showing a compressing unit of the conventional scroll compressor.
Figure 3:
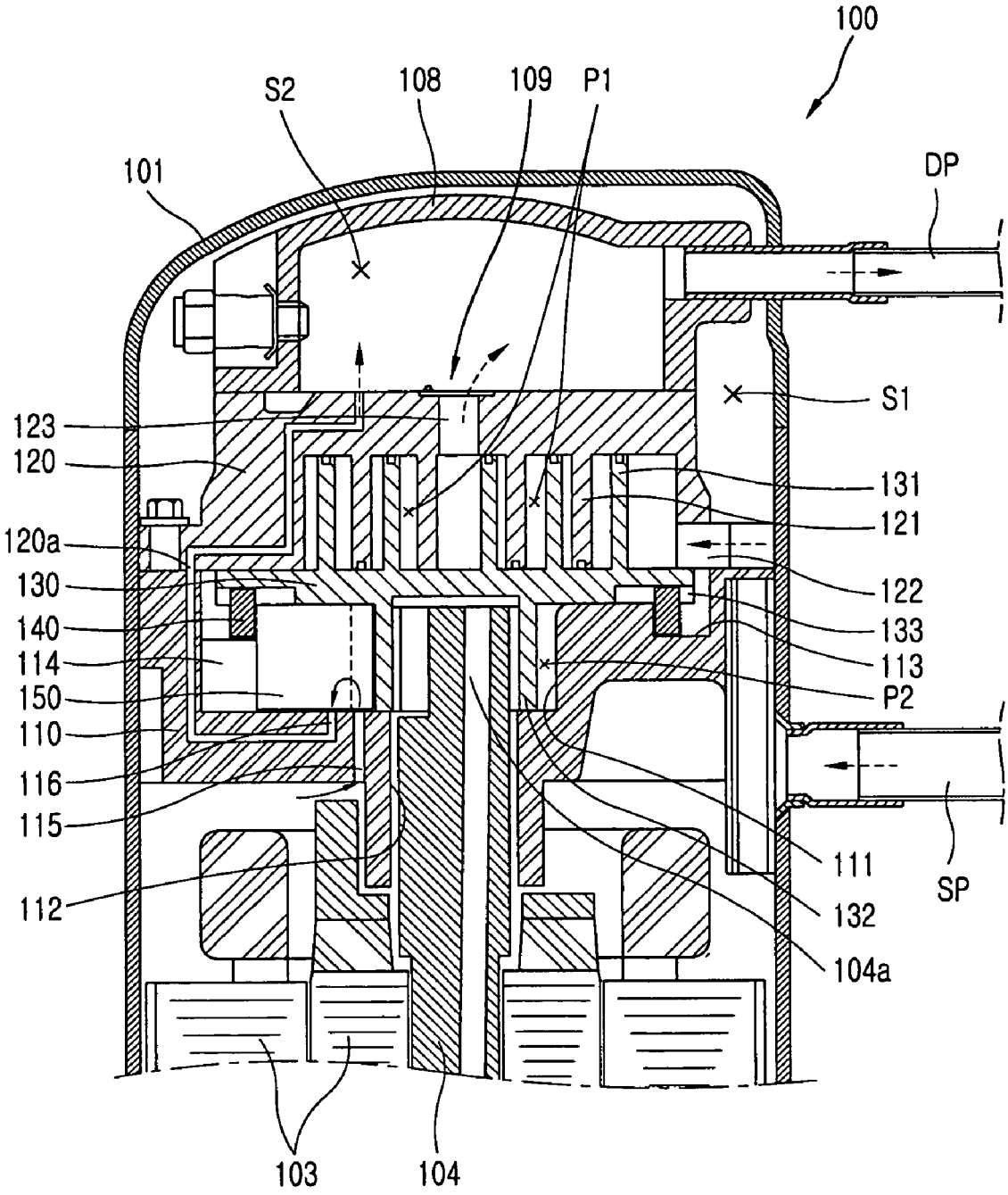
FIG. 3 is a longitudinal sectional view showing a part of a scroll compressor in accordance with a first embodiment of the present invention.
Figure 4:
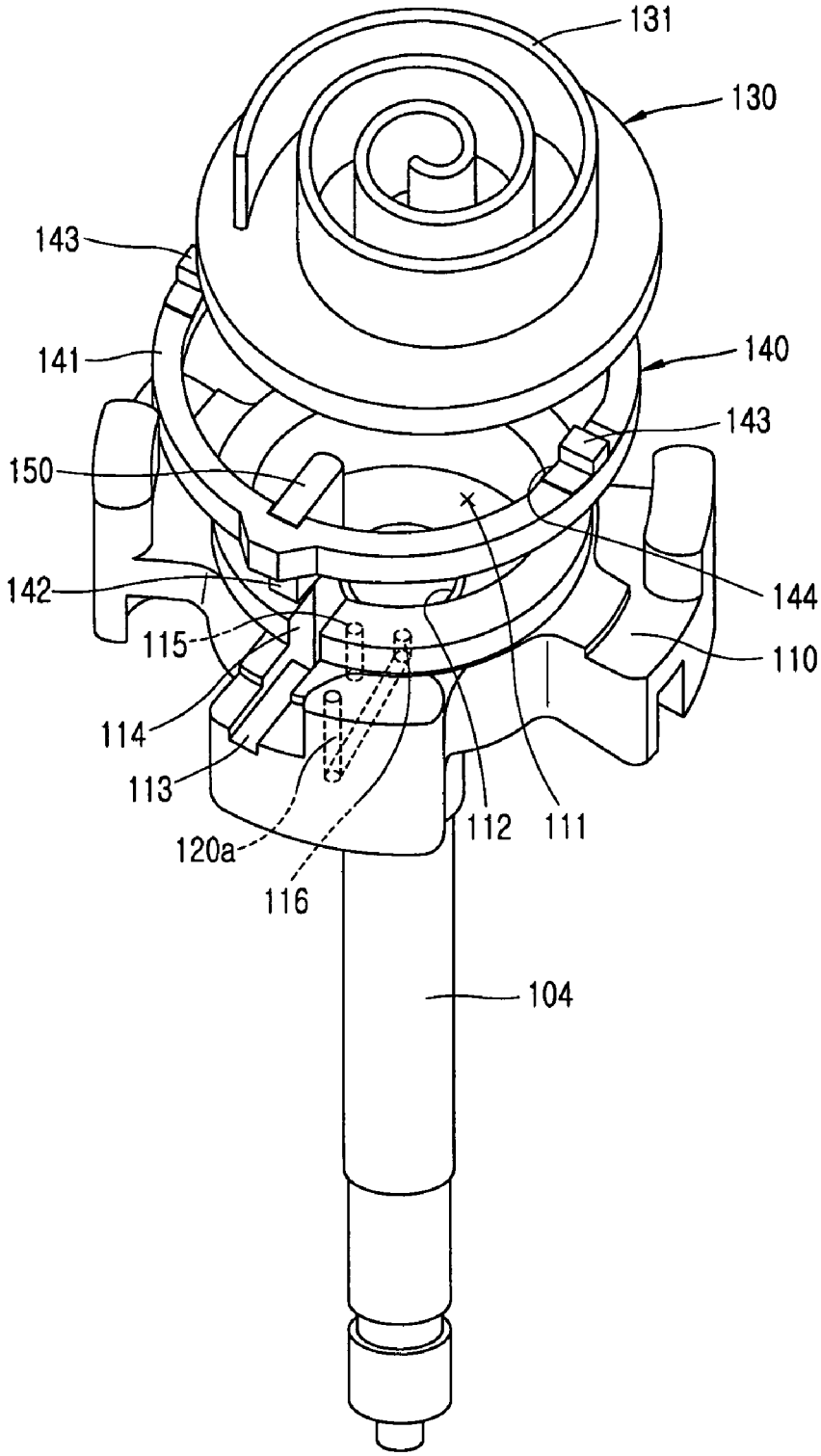
FIG. 4 is an exploded view showing a compression unit of the scroll compressor in accordance with the first embodiment of the present invention.
Figure 5:
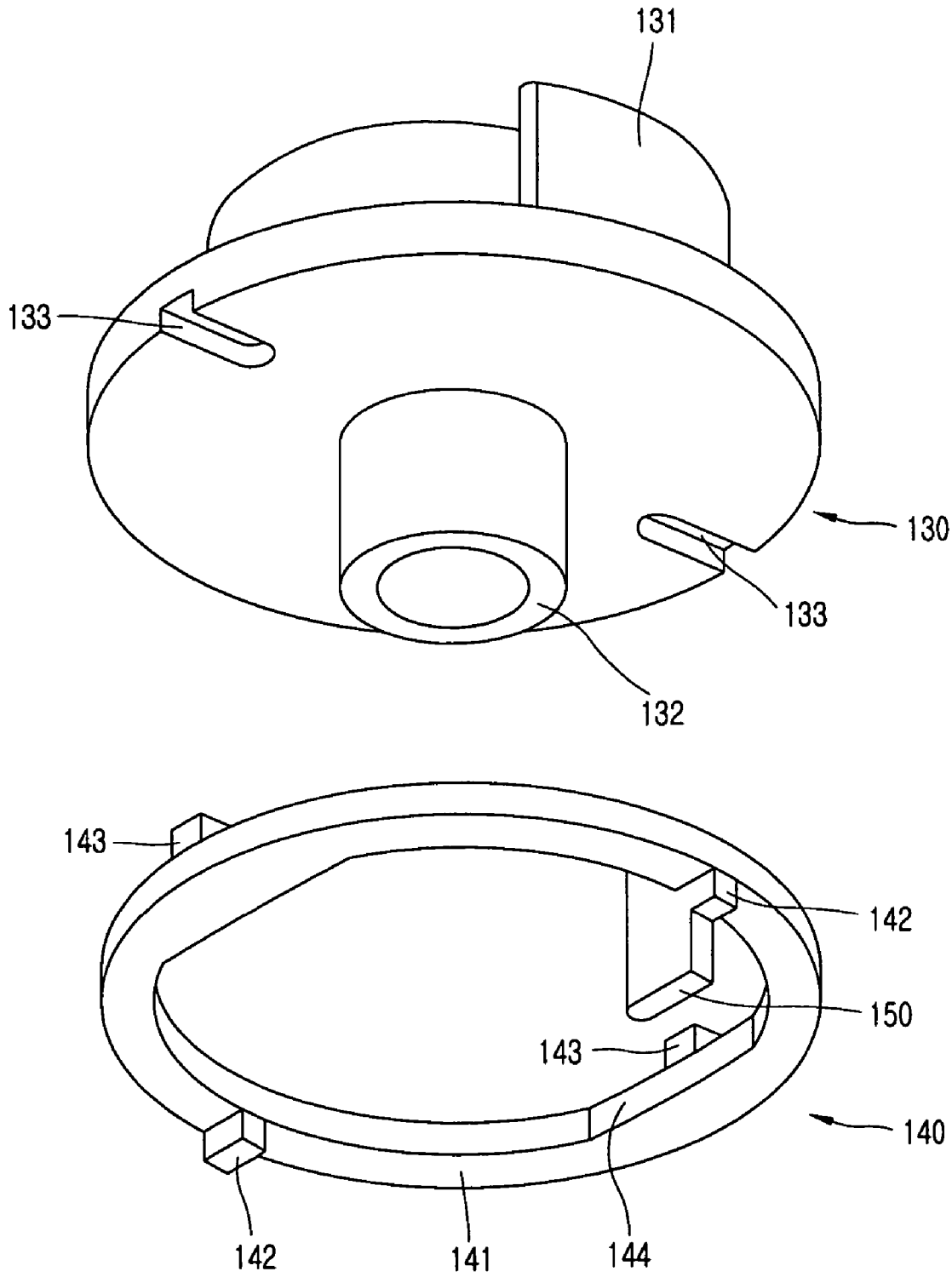
FIG. 5 is a bottom perspective view showing an orbiting scroll and a self-rotation preventing member in the scroll compressor in accordance with the first embodiment of the present invention.
Figure 6:
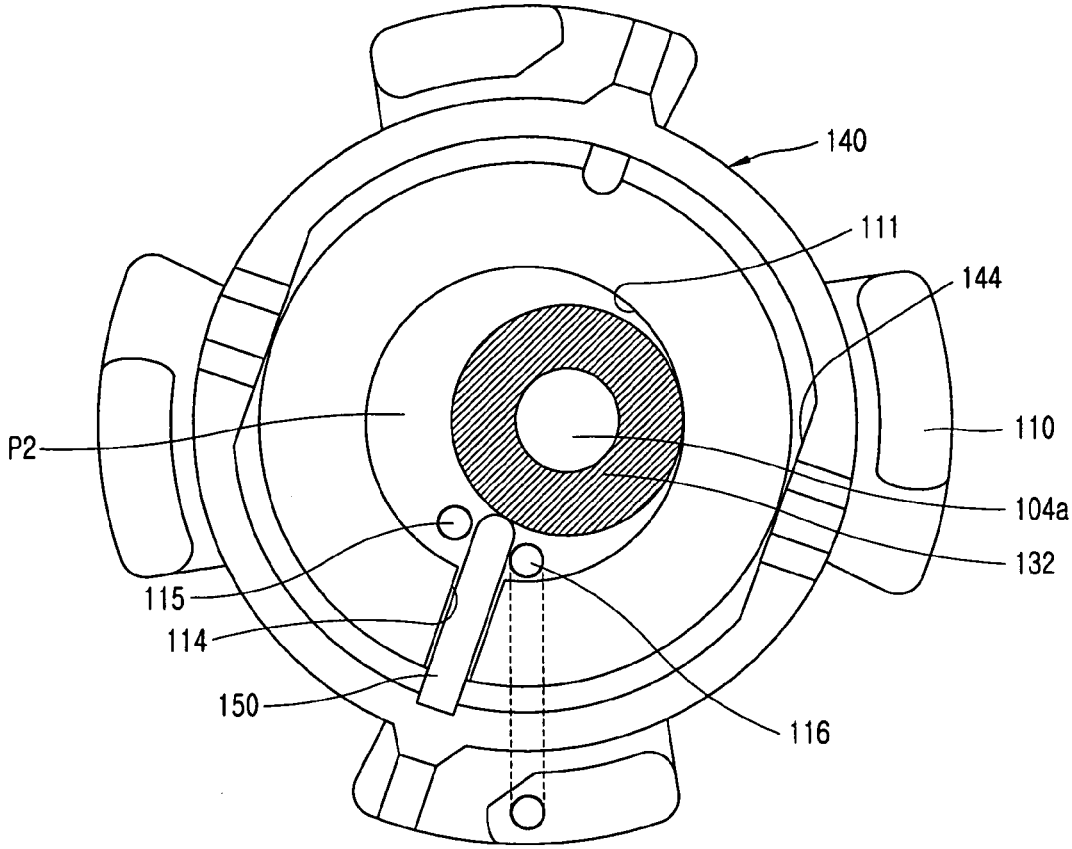
FIG. 6 is a plan view showing the compression unit of the scroll compressor in accordance with the first embodiment of the present invention.
Figure 7:
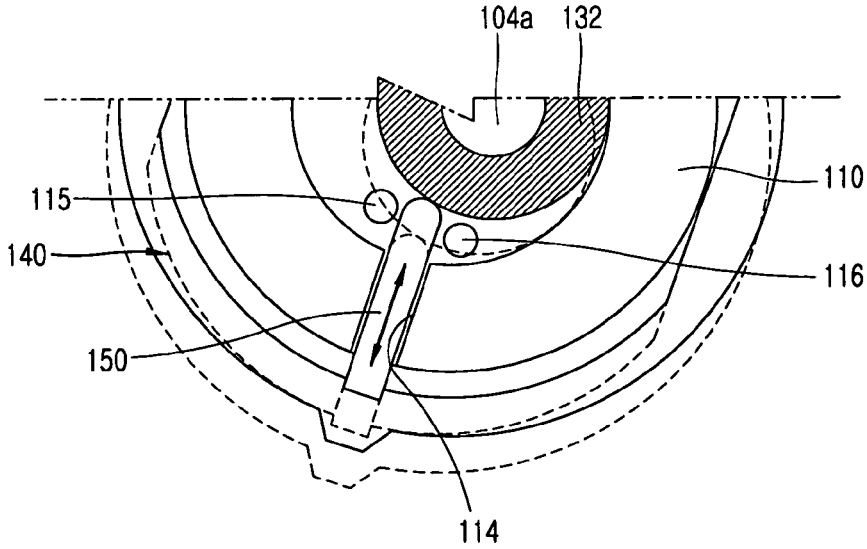
FIG. 7 is a bottom perspective view for explaining a use of a rolling piston inserted upon an outer circumferential surface of a boss portion of the orbiting scroll in the scroll compressor in accordance with the first embodiment of the present invention.

FIG. 3 is a longitudinal sectional view showing a part of a scroll compressor in accordance with a first embodiment of the present invention, FIG. 4 is an exploded view showing a compression unit of the scroll compressor in accordance with the first embodiment of the present invention, FIG. 5 is a bottom perspective view showing an orbiting scroll and a self-rotation preventing member in the scroll compressor in accordance with the first embodiment of the present invention, and FIG. 6 is a plan view showing the compression unit of the scroll compressor in accordance with the first embodiment of the present invention.

As shown, the scroll compressor 100 in accordance with the present invention includes: a casing 101 provided with a gas suction pipe (SP) through which a refrigerant gas is sucked and a gas discharge pipe (DP) through which the refrigerant gas is discharged; a driving motor 103 fixedly installed inside the casing 101; a frame 110 fixedly installed inside the casing 101 to support a rotary shaft 104 of the driving motor 103, and having a second suction opening 115 at its one side and a second discharge opening 116 at its other side; a fixed scroll 120 fixedly installed at the frame 110, and having a first suction opening 122 at its edgemost and a first discharge opening 123 at its central portion; an orbiting scroll 130 put on the frame 110, forming a first compression chamber (P1) by being engaged with the fixed scroll 120, and making a orbiting movement by being coupled to the rotary shaft 104; a self-rotation preventing member 140 interposed between the frame 110 and the orbiting scroll 130, for preventing a self-rotation of the orbiting scroll 130 and inducing an orbiting movement; and a vane 150 making a linear movement in a radial direction of the frame 110 by an orbiting movement of the orbiting scroll 130, for forming a second compression chamber (P2) including a space where the second suction opening 115 exists and a space where the second discharge opening 116 exists, between the frame 110 and the orbiting scroll 130.

More specifically, a boss receiving pocket 111 for an orbiting movement of a boss portion 132 of the orbiting scroll 130 is formed at a central portion of the frame 110, and a shaft hole 112 for supporting the rotary shaft 104 is formed at the center of the boss receiving pocket 111. Key groove portions 113 for allowing lower key portions 142 of the self-rotation preventing member 140 to slide in a radial direction are formed at both sides of an upper surface of the frame 110.

A second suction opening 115 communicating with a low pressure portion (S1) and guiding a refrigerant gas in the low pressure portion to the compression chamber (P2) is formed at one side of a bottom of the boss receiving pocket 111. A second discharge opening 116 communicating with the compression chamber (P2) and guiding the compressed refrigerant gas to a high pressure portion (S2) is formed at the other side of the bottom of the boss receiving pocket 111.

The second suction opening 115 penetrates upper and lower surfaces of the frame 110, and the second discharge opening 116 is connected to a gas passage 120*a* formed at the fixed scroll 120.

A wrap 121 forming a compression chamber (P1) by being engaged with a wrap 131 of the orbiting scroll 130 to be explained later is formed as an involute shape at a lower surface of the fixed scroll 120. A suction opening 121 is formed at the edgemost of the wrap 121, and a discharge opening 123 communicating with the high pressure portion (S2) of the casing 101 is formed around the center of the fixed scroll 120.

A wrap 131 engaged with the wrap 121 of the fixed scroll 120 is formed as an involute shape at an upper surface of the orbiting scroll 130. A boss portion 132 coupled to an eccentric portion 104*a* of the rotary shaft 140 to thereby make an orbiting movement in the boss receiving pocket 111 of the frame 110 is formed at a central portion of a lower surface of the orbiting scroll 130.

Key groove portions 133 are formed at both sides of the boss portion 132 of the orbiting scroll 130, namely, at a bottom of the orbiting scroll 130, so that upper key portions 143 of the self-rotation preventing member 140 slide in a radial direction.

As shown in FIG. 5, the self-rotation preventing member 140 includes: a body portion 141 formed as a ring shape; lower key portions 142 formed at both sides of a lower surface of the body portion 141 and slidingly inserted in the key groove portions of the frame 110; and upper key portions 143 formed at both sides of an upper surface of the body portion 141 and slidingly inserted in the key groove portions 131 of the orbiting scroll 130.

An outer circumferential surface of the body portion 141 is formed as a perfect circle, and sliding surfaces 144 are formed at both sides of its inner circumferential surface. The lower key portions 142 and the upper key portions 143 are alternately formed every angle of 90 along a circumferential direction.

A vane slit 114 is formed at the frame 110 in a radial direction of the frame 110 in order to guide a linear reciprocation of the vane 150.

The vane 150 is integrally formed at the self-rotation preventing member 140. Therefore, the vane 150 adheres to an outer circumferential surface of the boss portion 132 of the orbiting scroll 130, linearly moving in a radial direction of the frame 110 according to an orbiting movement of the orbiting scroll 130, and forms between the frame 110 and the orbiting scroll 130 a second compression chamber (P2) including a space where the second suction opening 115 exists and a space where the second discharge opening 116 exists, thereby increasing a capacity.

Figure 8:
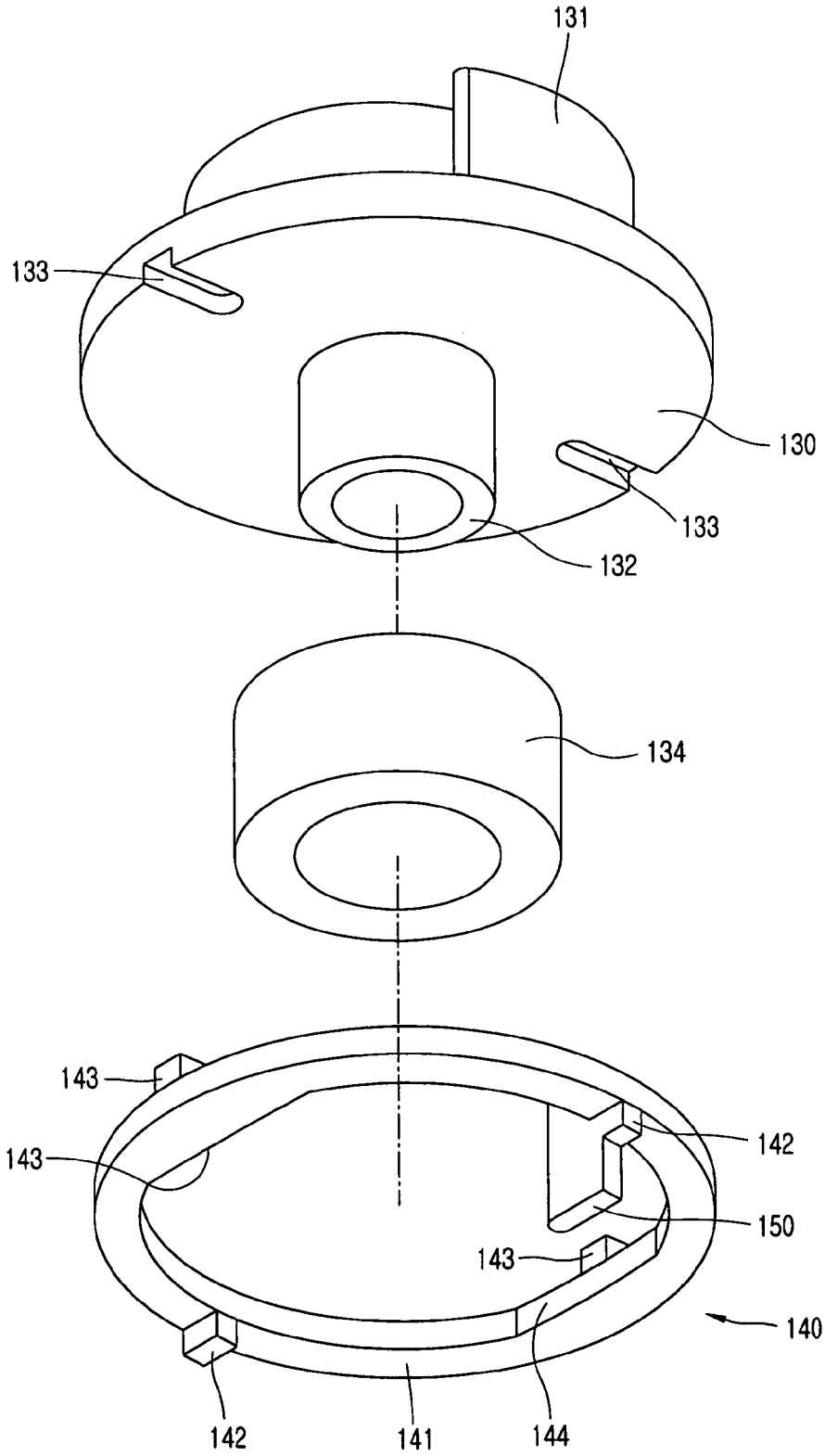
FIG. 8 is a plan view for explaining a use of the rolling piston inserted upon the outer circumferential surface of the boss portion of the orbiting scroll in the scroll compressor in accordance with the first embodiment of the present invention.
Figure 9:
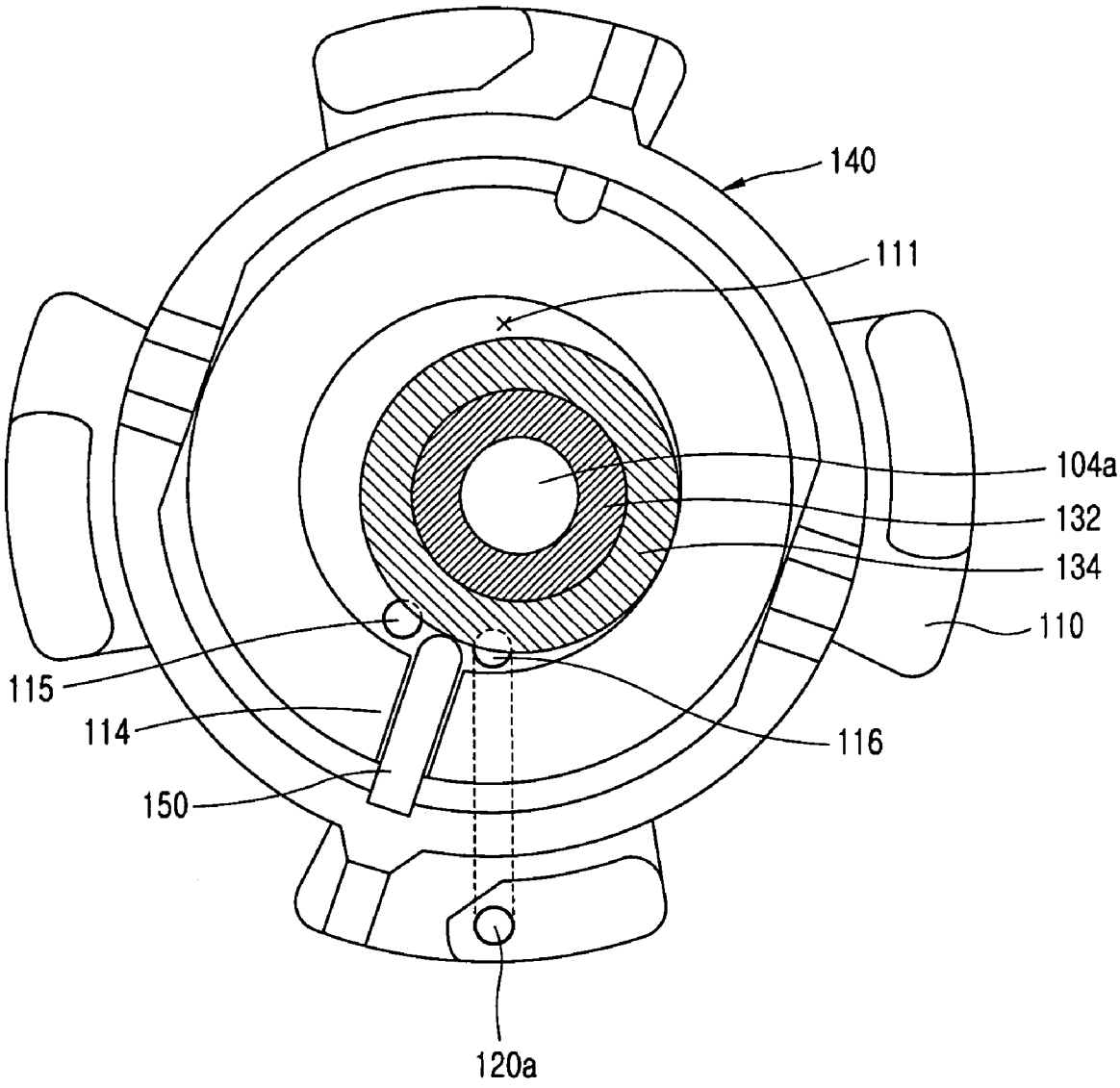
FIG. 9 is a plan view for explaining operation between the rolling piston and a vane in the scroll compressor in accordance with the first embodiment of the present invention.

Meanwhile, FIG. 8 is a plan view for explaining a use of a rolling piston inserted upon an outer circumferential surface of a boss portion of an orbiting scroll in the scroll compressor in accordance with the first embodiment of the present invention. FIG. 9 is a plan view showing a compression process of a rotary compression unit in the scroll compressor in accordance with the first embodiment of the present invention.

As shown, the vane 150 does not directly adhere to an outer circumferential surface of the boss portion 132 of the orbiting scroll 130 but may adhere to a rolling piston 134 inserted upon the outer circumferential surface of the boss portion 132. The vane 150 comes in contact with the outer circumferential surface of the rolling piston 134 in a state that the cylindrical rolling piston 134 is inserted upon the outer circumferential surface of the boss portion 132, thereby minimizing abrasion of not only the boss portion 132 but also the vane 150, and minimizing operation noise.

The operation of the scroll compressor in accordance with the first embodiment of the present invention having such a structure will now be described.

When the rotary shaft 104 of the driving motor 103 is rotated by applied power, the orbiting scroll 130 orbits. At this time, in a compression chamber (P1) formed between the wrap 131 of the orbiting scroll 130 and the wrap 121 of the fixed scroll 120, a refrigerant gas introduced from the suction opening 121 moves toward the discharge opening 123 to be discharged by a constant orbiting movement of the orbiting scroll 130.

The self-rotation preventing member 140 for preventing a self-rotation of the orbiting scroll 130 linearly moves in a radial direction of the frame 110. At this time, the vane 150 integrally formed at the self-rotation preventing member 140 is attached or adhered to an outer circumferential surface of the orbiting scroll 130, making a linear movement along the vane slit 114. Thus, the vane 150 forms a second compression chamber (P2) including a space where the second suction opening 115 exists and a space where the second discharge opening 116 exists, between the pocket receiving portion 111 and the boss portion 132.

In such a state, by a constant orbiting movement of the orbiting scroll 130, part of the refrigerant gas sucked into the low pressure portion (S1) of the casing 101 is introduced into the second compression chamber (P2) through the second suction opening 115, and the refrigerant gas introduced into the second compression chamber (P2) is discharged to the high pressure portion (S2) of the casing 101 through the second discharge opening 116 and the gas passage 120*a*.

The refrigerant gas introduced into the low pressure portion (S1) of the casing 101 through the gas suction opening (SP) is discharged to the high pressure portion (S2) of the casing 101 through a first suction opening 122 and a first discharge opening 123. At the same time, part of the refrigerant gas introduced to the low pressure portion (S1) of the casing 101 through the gas suction opening (SP) is discharged to the high pressure portion (S2) of the casing through the second suction opening 115, the second discharge opening 116 and the gas passage 120*a*, thereby increasing a capacity of the compressor.

Figure 10:
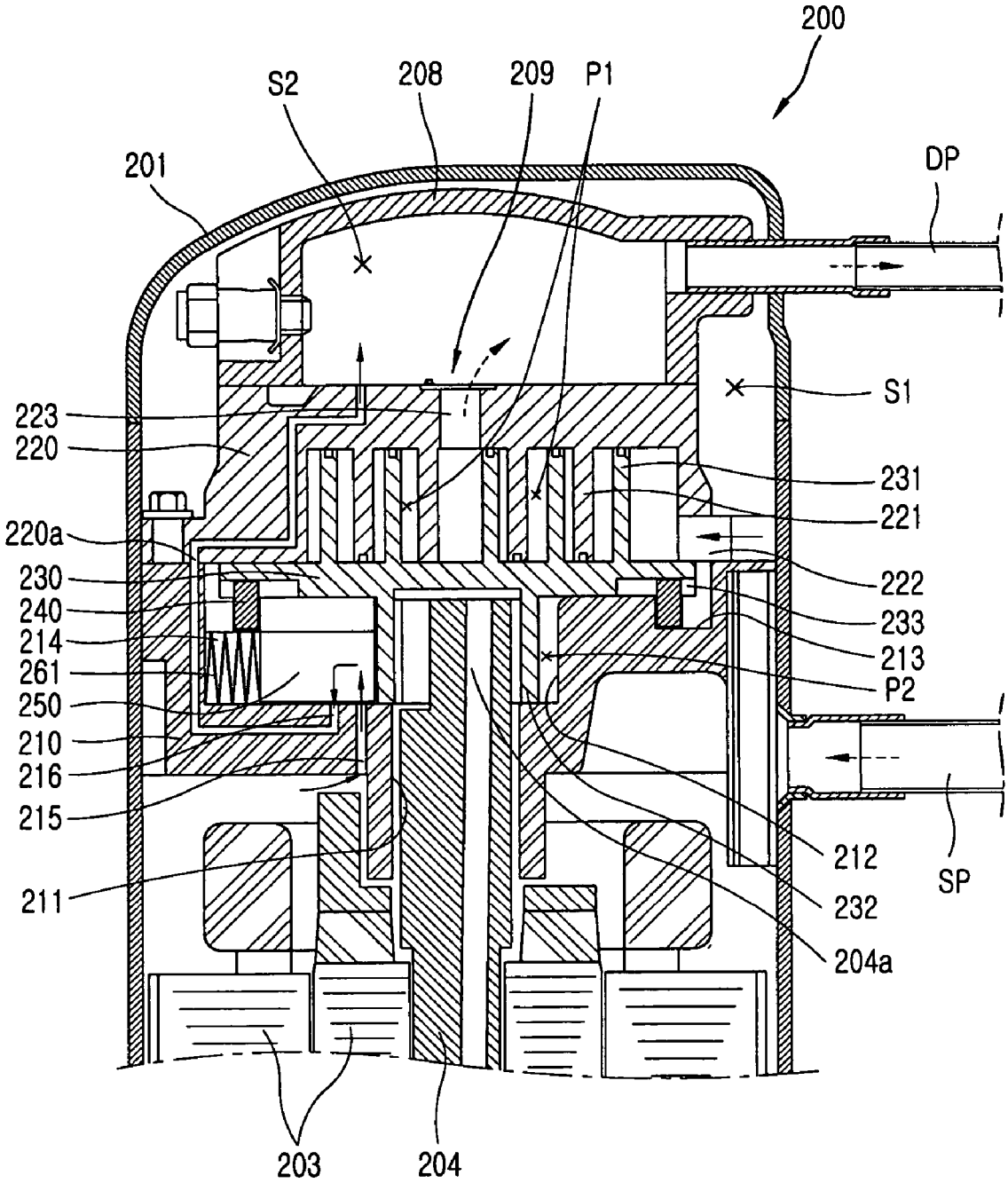
FIG. 10 is a longitudinal sectional view showing a scroll compressor in accordance with a second embodiment of the present invention.
Figure 11:
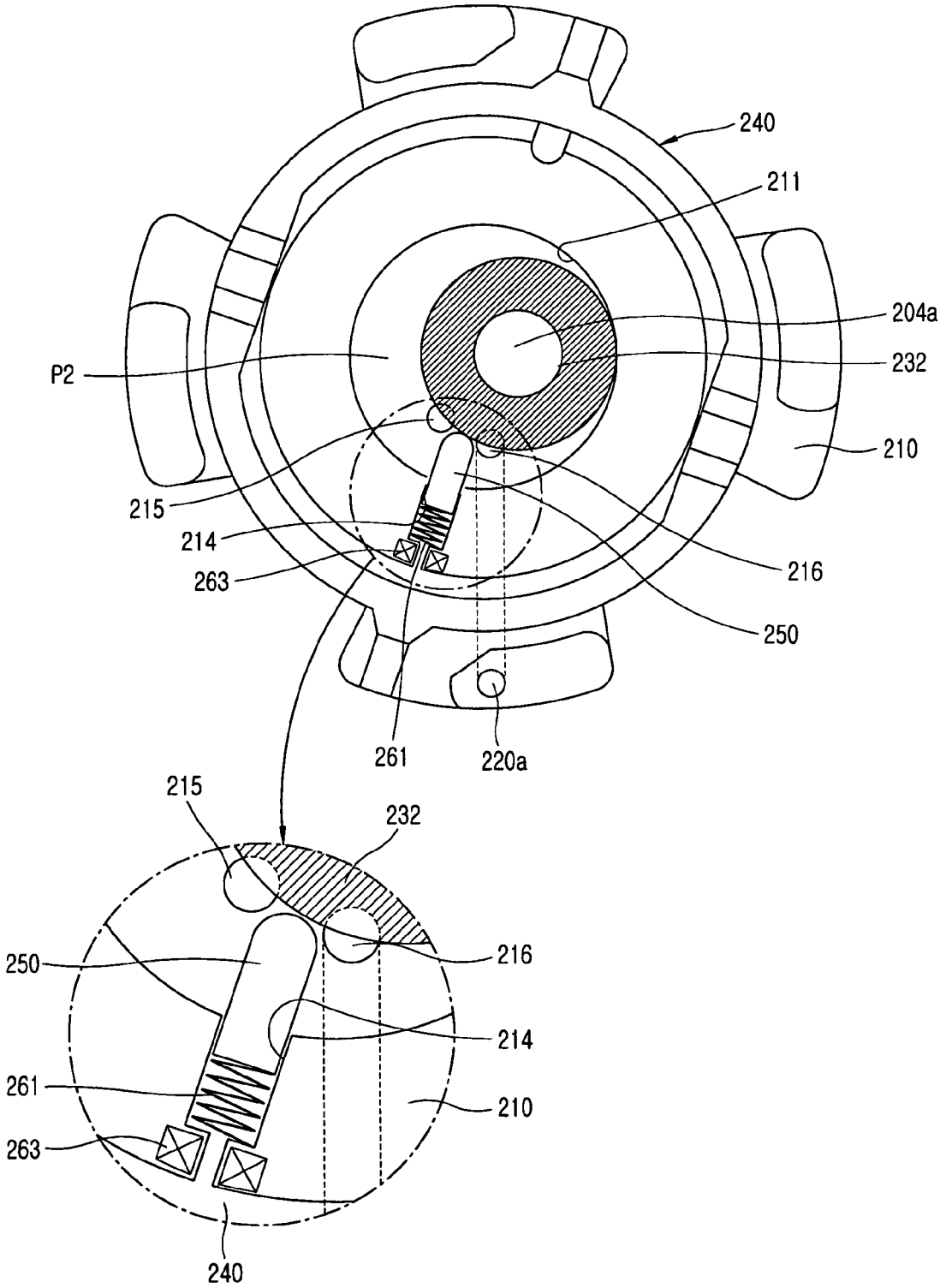
FIG. 11 is a plan view showing the scroll compressor in accordance with the second embodiment of the present invention.
Figure 12A:
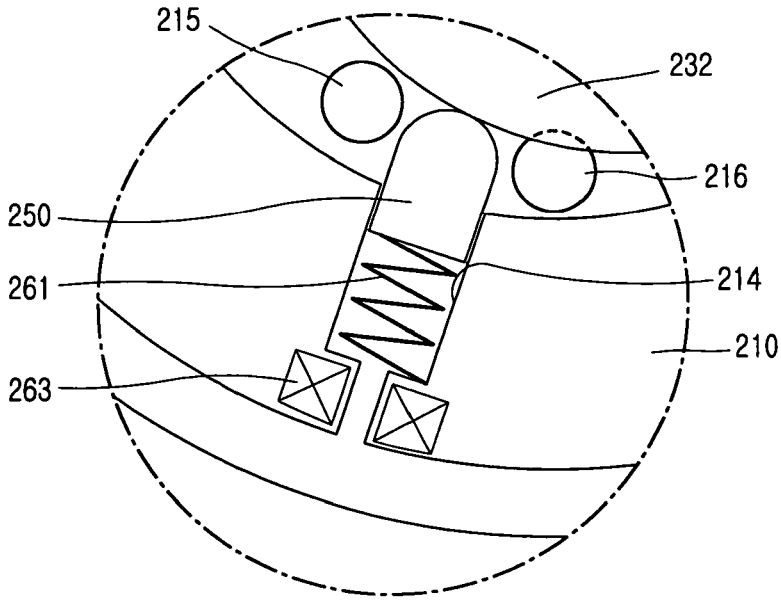
FIG. 12A is a plan view for explaining the operation of a vane in a high capacity mode in the scroll compressor in accordance with the second embodiment of the present invention.
Figure 12B:
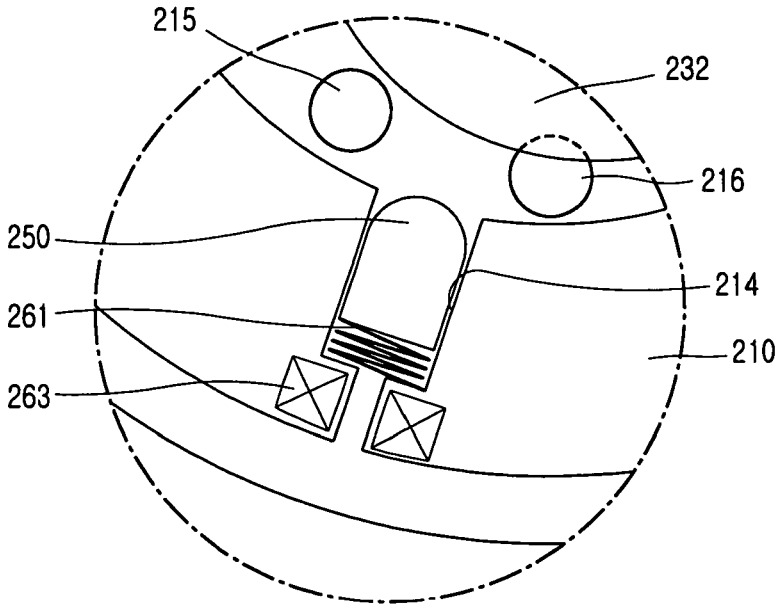
FIG. 12B is a plan view for explaining the operation of the vane in a low capacity mode in the scroll compressor in accordance with the second embodiment of the present invention.

FIG. 10 is a longitudinal sectional view showing a scroll compressor in accordance with a second embodiment of the present invention, FIG. 11 is a plan view showing the scroll compressor in accordance with the second embodiment of the present invention, FIG. 12A is a plan view for explaining the operation of a vane in a high capacity mode in the scroll compressor in accordance with the second embodiment of the present invention, and FIG. 12B is a plan view for explaining the operation of the vane in a low capacity mode in the scroll compressor in accordance with the second embodiment of the present invention.

As shown, in the scroll compressor 200 in accordance with the second embodiment of the present invention, a vane 250 is installed as a separate member from a self-rotation preventing member 240, and linearly moves by a vane control unit to be explained later to separate or connect a space where a second suction opening 215 exists from or with a space where a second discharge opening 216 exists, thereby freely controlling a capacity of the compressor.

A construction of the vane control unit for controlling a movement of the vane 250 will now be described.

The vane control unit includes: an elastic member 261 elastically supporting the vane 250 and adhering the vane 250 to an outer circumferential surface of the boss portion 232 of the orbiting scroll 230; and an electromagnet portion 263 fixedly installed at the frame 110, overcoming an elastic force of the elastic member 261 and drawing the vane 250 so that the vane 250 is separated from an outer circumferential surface of the boss portion 232.

The second suction opening 215 communicates with the low pressure portion (S1) of the casing 101, and the second discharge opening 216 communicates with the high pressure portion (S2) of the casing 101 through a gas passage 220*a*.

As shown in FIG. 12A, in the scroll compressor 200 in accordance with the second embodiment of the present invention having such a structure, when the compressor operates in a high capacity mode, the electromagnet portion 263 is turned off, thereby allowing the vane 250 to adhere to the outer circumferential surface of the boss portion 232 by an elastic force of the spring 261. Thus, in the same manner as described above, the vane 150 forms a second compression chamber (P2) having a space where the second suction opening 215 exists and a space where the second discharge opening 216 exists, between the boss receiving pocket 211 and the boss portion 231. In such a state, by a constant orbiting movement of the orbiting scroll 230, part of the refrigerant gas sucked to the low pressure portion (S1) of the casing 101 is introduced to the second compression chamber (P2) through the second suction opening 215, and the refrigerant gas introduced into the second compression chamber (P2) is discharged to the high pressure portion (S2) of the casing 101 through the second discharging opening 216 and the gas passage 220*a*.

In contrast, as shown in FIG. 12B, when the compressor operates in a low capacity mode, the electromagnet portion 263 is turned on to draw the vane 250, thereby overcoming an elastic force of the spring 261 and separating the vane 250 from an outer circumferential surface of the boss portion 232. Thus, the second suction opening 215 and the second discharge opening 216 are connected to each other. Therefore, the refrigerant gas is compressed/discharged only in/from the first compressions chamber (P1) formed by a wrap 221 of the fixed scroll 220 and a wrap 231 of the orbiting scroll 230, thereby lowering a capacity of the compressor.

In the scroll compressor 220 in accordance with the second embodiment of the present invention, the second compression chamber (P2) is formed as a separate chamber from the first compression chamber (P1). By controlling the vane 250, both first compression chamber and second compression chamber are used in a high capacity mode to compress and discharge a refrigerant gas, and only the first compression chamber is used in a low capacity mode to compress and discharge the refrigerant gas. In such a manner, the capacity is easily controlled.

Figure 13:
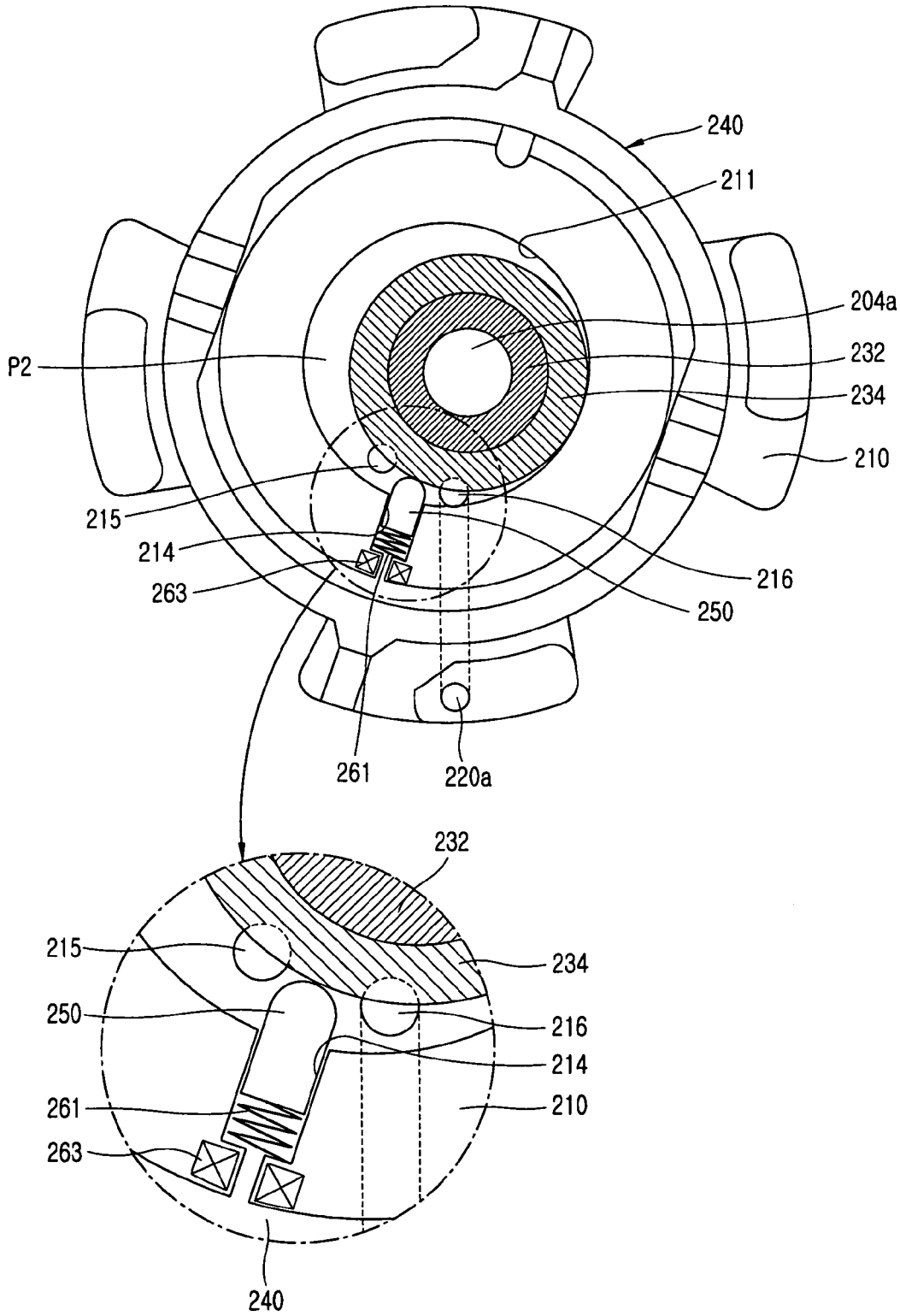
FIG. 13 is a plan view for explaining a use of a rolling piston inserted upon an outer circumferential surface of the boss portion of the orbiting scroll in the scroll compressor in accordance with the second embodiment of the present invention.

Meanwhile, FIG. 13 is a plan view for explaining a use of a rolling piston inserted upon an outer circumferential surface of the boss portion of the orbiting scroll in the scroll compressor in accordance with the second embodiment of the present invention.

As shown, the vane 250 may not directly adhere to an outer circumferential surface of the boss portion 232 of the orbiting scroll 230, but may adhere to a rolling piston 234 inserted upon an outer circumferential surface of the boss portion 232. By inserting the cylindrical rolling piston 234 upon the outer circumferential surface of the boss portion 232 of the orbiting scroll 230, abrasion of not only the boss portion 232 but also the vane 250 is minimized, and operation noise is also minimized.

As so far described, in the scroll compressor in accordance with the present invention, besides a first compression chamber, a second compression chamber for discharging part of a refrigerant gas of a low pressure portion to a high pressure portion is additionally formed between a boss receiving pocket and a boss portion of an orbiting scroll, thereby effectively increasing a capacity of the compressor.

Also, by controlling a movement of a vane, both first compression chamber and second compression chamber are used in a high capacity mode to compress and discharge a refrigerant, and only the first compression chamber is used in a low capacity mode to compress and discharge the refrigerant gas. In such a manner, a capacity is easily controlled.

In addition, the vane does not directly adhere to an outer circumferential surface of a boss portion of the orbiting scroll but adhere to a rolling piston inserted upon an outer circumferential surface of the boss portion, thereby minimizing abrasion of not only the boss portion but also the vane and minimizing operation noise.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a driving motor fixedly installed in a casing;

a frame fixedly installed in the casing to support a rotary shaft of the driving motor, and having a second suction opening at its one side and a second discharge opening at its other side;

a fixed scroll fixedly installed at the frame and having a first suction opening at its edgemost and a first discharge opening at its central portion;

an orbiting scroll put on the frame, forming a first compression chamber by being engaged with the fixed scroll, and making an orbiting movement by being coupled to the rotary shaft;

a self-rotation preventing member interposed between the frame and the orbiting scroll, for preventing a self-rotation of the orbiting scroll and inducing an orbiting movement of the orbiting scroll; and a vane making a linear movement in a radial direction of the frame according to an orbiting movement of the orbiting scroll, and forming between the frame and the orbiting scroll a second compression chamber including a space where the second suction opening exists and a space where the second discharge opening exists.

2. The scroll compressor of claim 1, wherein a vane slit is formed at the frame in a radial direction of the frame in order to guide a linear reciprocation of the vane.

3. The scroll compressor of claim 1, wherein the vane is integrally formed at the self-rotation preventing member.

4. The scroll compressor of claim 1, wherein the vane selectively adheres to an outer circumferential surface of a boss portion of the orbiting scroll.

5. The scroll compressor of claim 4, further comprising a vane control unit wherein the vane control unit comprises:

an elastic member for elastically supporting the vane to adhere the vane to an outer circumferential surface of the boss portion of the orbiting scroll; and an electromagnet portion fixedly installed at the frame, overcoming an elastic force of the elastic member and drawing the vane so as to separate the vane from the outer circumferential surface of the boss portion.

6. The scroll compressor of claim 1, wherein a rolling piston is inserted upon an outer circumferential surface of a boss portion of the orbiting scroll, and the vane selectively adheres to an outer circumferential surface of the rolling piston.

7. The scroll compressor of claim 1, wherein the vane is installed to be separable from the self-rotation preventing member.

8. The scroll compressor of claim 7, further comprising:

a vane control unit formed at one side of the frame so as to control a movement of the vane.

9. The scroll compressor of claim 1, wherein the second suction opening communicates with a low pressure portion of the casing, and the second discharge opening communicates with a high pressure portion of the casing.

10. A scroll compressor comprising:

a frame fixedly installed in a casing to support a rotary shaft of a driving motor, and having a second suction opening at its one side, a second discharge opening at another side and a vane slit at still another side;

a fixed scroll fixedly installed at the frame and having a wrap of an involute shape at its upper surface, a first suction opening at its edgemost and a first discharge opening at its central portion;

an orbiting scroll having a wrap of an involute shape at its upper surface so that the wrap forms a first compression chamber by being engaged with the wrap of the fixed scroll, and having at its lower surface a boss portion where an eccentric portion of the rotary shaft is inserted to thereby make an orbiting movement by a rotation of the rotary shaft;

a self-rotation preventing member interposed between the frame and the orbiting scroll, for preventing a self-rotation of the orbiting scroll and inducing an orbiting movement; and a vane making a linear movement in a radial direction of the frame according to an orbiting movement of the orbiting scroll, and forming a second compression chamber including a space where the second suction opening exists and a space where the second discharge opening exists, between the frame and the orbiting scroll.

11. The scroll compressor of claim 10, wherein the vane is integrally formed at the self-rotation preventing member.

12. The scroll compressor of claim 11, wherein the second suction opening communicates with a low pressure portion of the casing, and the second discharge opening communicates with a high pressure portion of the casing.

13. The scroll compressor of claim 10, wherein the vane selectively adheres to an outer circumferential surface of a boss portion of the orbiting scroll.

14. The scroll compressor of claim 10, wherein a rolling piston is inserted upon an outer circumferential surface of a boss portion of the orbiting scroll, and the vane selectively adheres to an outer circumferential surface of the rolling piston.

15. The scroll compressor of claim 14, further comprising:

a vane control unit formed at one side of the frame for controlling a movement of the vane.

16. The scroll compressor of claim 15, wherein the vane control unit comprises:

an elastic member for elastically supporting the vane to adhere the vane to an outer circumferential surface of the rolling piston; and an electromagnet portion fixedly installed at the frame, overcoming an elastic force of the elastic member and drawing the vane so as to separate the vane from the outer circumferential surface of the rolling piston.

17. The scroll compressor of claim 10, wherein the vane is installed to be separable from the self-rotation preventing member.

* * * * *